US007335142B2

(12) United States Patent
Towley, III et al.

(10) Patent No.: US 7,335,142 B2
(45) Date of Patent: Feb. 26, 2008

(54) SELECTORIZED DUMBBELL WEIGHT WITH WEIGHT PLATES FORMED BY A PAIR OF WELDED WEIGHT SUBPLATES AND METHOD OF MANUFACTURE THEREOF

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 41 days.

(21) Appl. No.: 11/243,724

(22) Filed: Oct. 5, 2005

(65) Prior Publication Data

US 2007/0087918 A1 Apr. 19, 2007

(51) Int. Cl.
*A63B 21/072* (2006.01)
*A63B 21/075* (2006.01)

(52) U.S. Cl. ..... 482/107; 482/108

(58) Field of Classification Search ..... 482/93, 482/94, 97, 98, 107, 108, 106; 228/173.3, 228/173.4, 173.5, 135, 138, 144, 153, 178, 228/182

See application file for complete search history.

(56) References Cited

U.S. PATENT DOCUMENTS 1,672,944 A * 6/1928 Jowett ..... 482/108
1,853,916 A * 4/1932 McLaughlin ..... 16/217
5,628,716 A * 5/1997 Brice ..... 482/106
5,637,064 A * 6/1997 Olson et al. ..... 482/108
6,149,558 A * 11/2000 Chen ..... 482/107
2004/0005968 A1* 1/2004 Crawford et al. ..... 482/106
2005/0227831 A1* 10/2005 Mills et al. ..... 482/106

OTHER PUBLICATIONS

Two Photographs showing weight from Nautilus/Bowflex Select-Tech dumbbell (undated).

* cited by examiner

*Primary Examiner*—Stephen R. Crow
*Assistant Examiner*—Sundhara M Ganesan
(74) *Attorney, Agent, or Firm*—James W. Miller

(57) ABSTRACT

This invention relates to a selectorized dumbbell having a handle that can be dropped down between nested left and right stacks of weight plates. The weight plates can comprise individual weights or a pair of weight plates, one from each stack, can be connected together to form a single weight. A selector is provided to allow the user to select a desired number of weight plates from each stack and couple such weight plates to the handle to provide an adjustable weight dumbbell. Each weight plate comprises a pair of thinner or partial thickness weight subplates that are abutted and welded together, e.g. a ½" weight plate is formed by a pair of ¼" weight subplates. This substantially decreases the cost of manufacturing the selectorized dumbbell.

10 Claims, 4 Drawing Sheets

SELECTORIZED DUMBBELL WEIGHT WITH WEIGHT PLATES FORMED BY A PAIR OF WELDED WEIGHT SUBPLATES AND METHOD OF MANUFACTURE THEREOF

TECHNICAL FIELD

This invention relates to a selectorized dumbbell having a handle which carries an adjustable number of weights depending upon the position of a manually movable selector. More particularly, this invention relates to a method of manufacturing the weights for such a selectorized dumbbell and to the weights produced by such manufacturing method.

BACKGROUND OF THE INVENTION

The PowerBlock® is a well known selectorized dumbbell manufactured and sold by Intellbell, Inc. of Owatonna, Minn. In such a dumbbell, a plurality of weights are provided that form a set of nested left weight plates and a set of nested right weight plates. The two sets of nested weight plates are laterally separated from one another by a space or gap. A handle can be inserted or dropped down into the gap to allow the handle to pick up a desired number of weight plates from each stack. The amount of the exercise mass provided by the selectorized dumbbell depends upon how many weight plates from each stack are coupled to each end of the handle.

In the PowerBlock® selectorized dumbbell, each weight comprises a left weight plate that is integrally joined to a corresponding right weight plate by a pair of side rails. The side rails are welded at each end to one side of each weight plate. One side rail is welded to the front sides of the left and right weight plates. The other side rail is welded to the rear side of the left and right side plates.

FIG. 3 of this application shows a single weight from the PowerBlock® selectorized dumbbell. The weight is formed by a joined pair of weight plates with only the front side rail being shown in FIG. 3, the rear side rail being hidden on the other side of the weight plates in FIG. 3. The weight plates in different weights are spaced further apart and the side rails used to join these weight plates together are correspondingly longer and vertically offset. This permits the nesting of the weight plates together in their respective left and right stacks of weight plates.

The selector in the PowerBlock® selectorized dumbbell comprises a pin that may be selectively positioned beneath the side rails of any desired weight. Thus, when the selector is so positioned and the handle is lifted, the handle will carry with it the weight selected by the position of the pin along with all weights above the selected weight. The amount of the weight carried by the handle is adjusted by vertically repositioning the pin so as to insert the pin beneath a higher or lower side rail.

In the past, certain models of PowerBlock® selectorized dumbbells have used ½" stamped steel plates as the weight plates in manufacturing the individual weights. Such ½" weight plates typically have significant manufacturing imperfections along the edges thereof. These imperfections include burrs, rough spots, and the like, formed by the edges of the stamping die when the weight plates are stamped out of ½" steel stock. Thus, it was necessary to use a CNC milling machine to mill the edges of such ½" weight plates to remove such imperfections and in doing so the ½" weight plates were provided with curved edges along all four sides thereof.

FIG. 5 shows in phantom the roughly rectangular edges of the ½" weight plate as it came out of the die and in solid the curved edge formed by the milling step. Obviously, the material between the curved edge and the phantom line rectangular edge represents the material removed during the milling step. In addition, each ½" weight plate also had a pair of mounting holes stamped through each plate in order to secure the plate to the milling machine used in the milling operation. Such holes also represent a significant loss of material from each ½" weight plate.

After the edges of the ½" weight plates were milled as described above, two such plates were then inserted into a welding fixture at whatever spacing was appropriate to the weight being manufactured. The two side rails for this weight were then welded to the weight plates at generally identical heights along the front and rear sides of the weight plates to join the weight plates together. The weight plates and side rails were then cleaned of debris and contaminants by spraying them with a cleaner. Finally, the weight formed by the weight plates and the side rails went through a powder coating process to apply a finish coating to the side rails and to both sides of the weight plates.

While this is an effective way to manufacture weights for selectorized dumbbells, it does involve labor in terms of milling the edges of the weight plates to make them sufficiently smooth to be acceptable. In addition, given recent price increases for ½" steel stock, the prices for obtaining ½" stamped steel plates has dramatically increased. This forces the manufacturer of selectorized dumbbells to either increase prices, which is not favored by the purchasers of such dumbbells, or to make less margin on the product, which is not favored by the manufacturer. A simpler and less expensive way to manufacture selectorized dumbbell weights would be an advance in the art.

SUMMARY OF THE INVENTION

One aspect of this invention relates to a selectorized dumbbell having a handle. A plurality of weights are nested together forming a nested first stack of weight plates and a nested second stack of weight plates. The first and second stacks of weight plates are separated by a gap that is large enough to accommodate at least a portion of the handle therebetween. A selector is movable by a user to allow a desired number of weight plates from each of the first and second stacks to be coupled to either end of the handle when the handle portion is located in the gap between the first and second stacks and the selector is manipulated by the user. The weight plates comprise full thickness weight plates. Each full thickness weight plate comprises a plurality of partial thickness stamped steel weight subplates that are abutted with one another and welded to one another to form the full thickness weight plate.

Another aspect of this invention relates to a method of manufacturing a weight for use in a selectorized dumbbell. The selectorized dumbbell has a plurality of nested weights disposed in a stack of nested left weight plates and nested right weight plates, the weight plates each having a predetermined full thickness. The method comprises providing a plurality of stamped steel weight subplates having a partial thickness compared to the full thickness of the weight plate, abutting at least a pair of the weight subplates against one another in a face-to-face manner to form each weight plate in the weight; and welding the weight subplates together.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
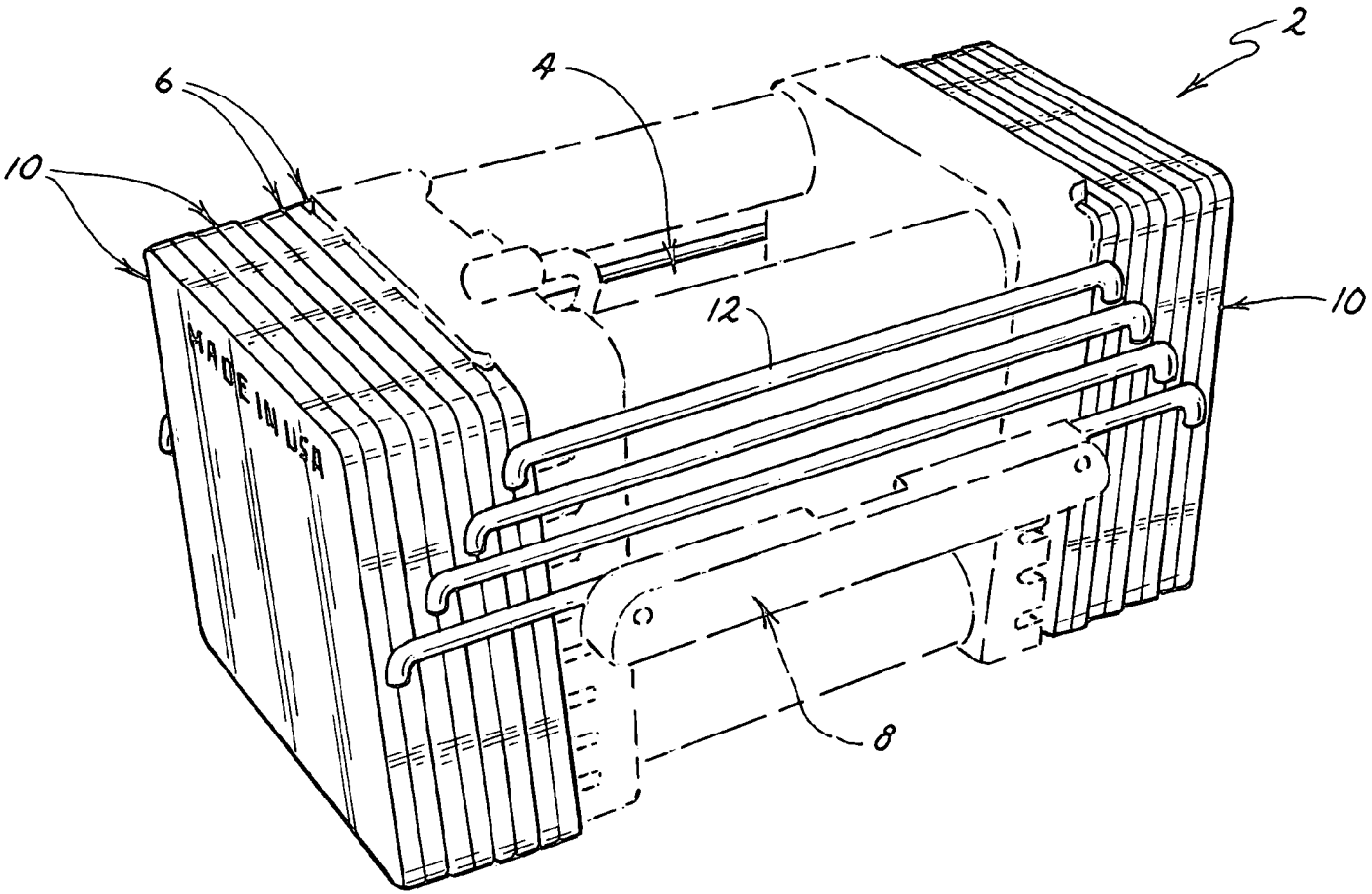
FIG. 1 is a perspective view of a selectorized dumbbell according to this invention, particularly illustrating the nested weights of the dumbbell with each weight having a ½" weight plate at each end, the ½" weight plate being formed from a pair of joined ¼" weight subplates.
Figure 2:
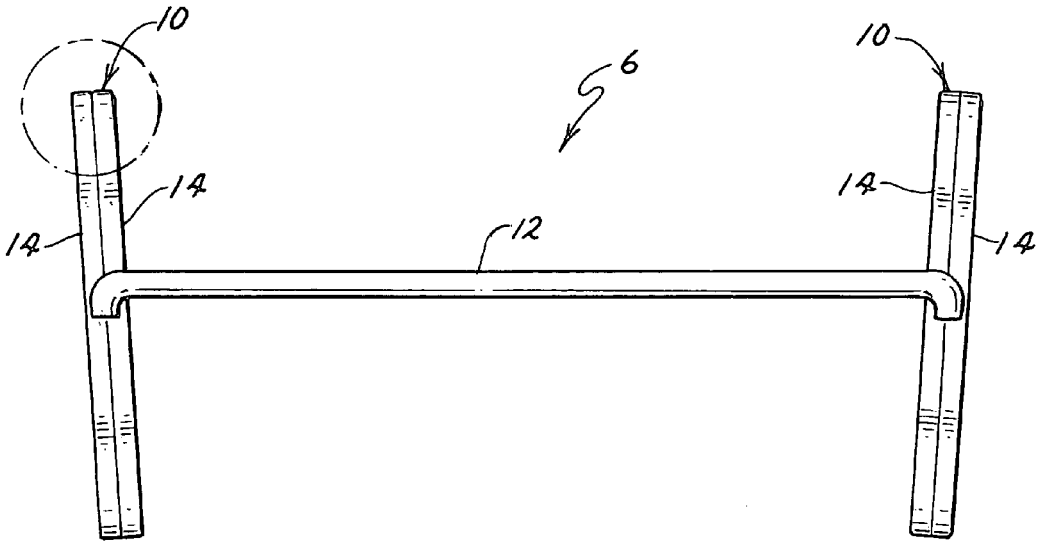
FIG. 2 is a side elevational view of a selectorized dumbbell weight according to this invention.
Figure 3:
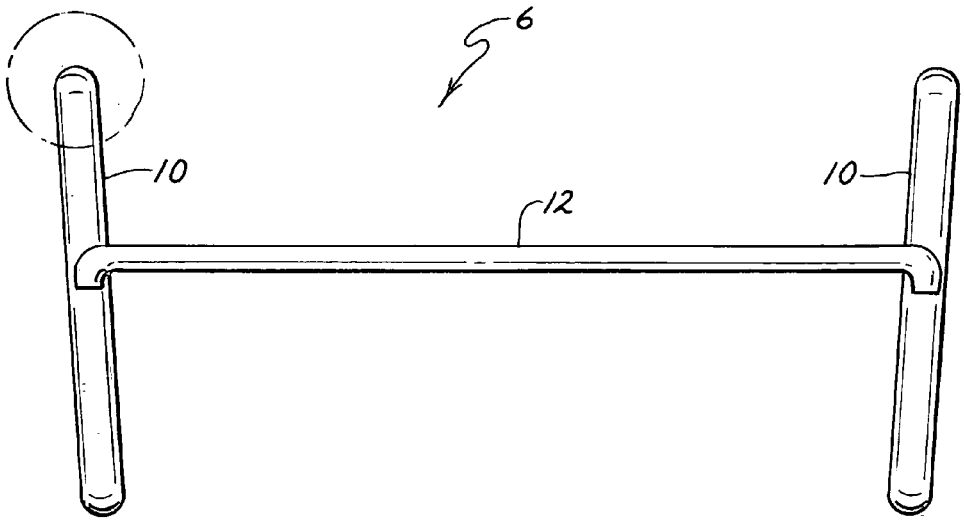
FIG. 3 PRIOR ART
FIG. 3 is a side elevational view similar to FIG. 2, but showing a prior art selectorized dumbbell weight.
Figure 5:
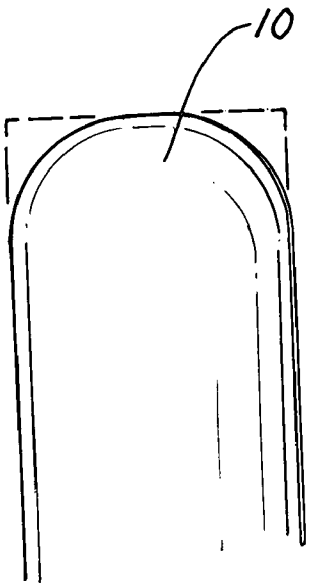
FIG. 5 PRIOR ART
FIG. 5 is an enlarged side elevational view similar to FIG. 4 of the edges of the prior art selectorized dumbbell weight of FIG. 3, particularly illustrating the edges in phantom as they appear coming from the stamping die and in solid after being milled by a milling tool.
Figure 4:
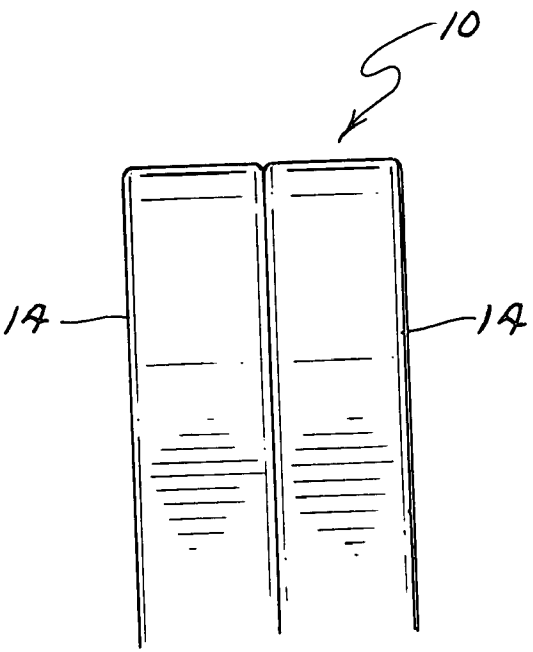
FIG. 4 is an enlarged side elevational view of the edges of the selectorized dumbbell weight of FIG. 2.

Referring first to FIG. 1, a first embodiment of a selectorized dumbbell is illustrated generally as 2. Dumbbell 2 as shown herein is similar to an existing product known as the PowerBlock® which is manufactured and sold by Intellbell, Inc. of Owatonna, Minn., and which is shown in the Applicants' U.S. Pat. No. 5,779,604, which is hereby incorporated by reference. A summary description of dumbbell 2 will be provided herein only as needed to understand this invention. Reference may be had to U.S. Pat. No. 5,779,604 for a fuller and more complete description of dumbbell 2.

Basically, dumbbell 2 includes a handle 4 and a plurality of nested weights 6 which can be selectively coupled to handle 4 using a selector 8, namely a pin that can be moved between different positions on handle 4. Each weight includes a pair of ½" weight plates 10 that are joined along each side by a side rail 12. Side rail 12 has one end joined to one weight plate 10 in each pair and the other end joined to the other weight plate 10 in each pair.

Side rails 12 hold weight plates 10 apart by a predetermined distance corresponding to the length of side rails 12. Different weights 6 have different length side rails 12 so that weight plates 10 in different weights 6 are spaced apart by different distances. Side rails 12 of different weights 6 are joined to weight plates 10 at different vertical heights, with the heights of side rails 12 decreasing as the distance between weight plates 10 increases. See FIG. 1. Thus, weights 6 can be nested together with weight plates 10 on one side forming a first or left stack of nested weight plates and weight plates 10 on the other side forming a second or right stack of nested weight plates.

A desired number of weights 6 can be selectively coupled to handle 4 depending upon how selector 8 is positioned. If selector 8 is inserted into handle 4 beneath the lowermost side rails 12, then selector 8 will pick up all weights 6 when handle 4 is lifted. Moving the selector 8 up will pick up fewer weights to thereby adjust the exercise mass carried by handle 4. Essentially, only those weights 6 whose side rails 12 are above the location of selector 8 will be coupled to handle 4.

This invention is based upon forming each ½" weight plate 10 from a pair of ¼" weight subplates 14 that are joined together in the manner to be described hereafter. Doing so provides a weight 6 for dumbbell 2 that is dramatically less expensive to manufacture. This provides a competitive advantage to a manufacturer that uses such a weight 6.

The term "subplate" to describe the ¼" weight subplates 14 has been adopted only as a device to distinguish the ¼" weight subplates from the ½" weight plate 10 formed thereby. It does not mean that the ¼" weight subplates 14 are not "plates" in the normal sense of the word, but only that multiple thinner subplates are used to form what is going to be referred to herein as a plate.

One might logically expect that a ¼" steel subplate would cost approximately one half of the cost of a ½" steel plate of the same size. Thus, if a ½" steel plate were to cost $1.00, one would expect a ¼" steel subplate to cost $0.50. However, the Applicants realized this is not typically the case and that a ½" steel subplate in the above example costs less than $0.50. The Applicants discovered that this is due to the faster tool cycle time used in stamping out ¼" steel subplates along with the fact that there is less waste or selvage in the steel sheet when stamping out ¼" steel subplates as compared to ½" steel plates. Thus, a fact first appreciated by the Applicants is that ¼" steel subplates cost disproportionately less than ½" steel plates. One can buy two ¼" steel subplates for less than one ½" steel plate of the same size.

Moreover, the Applicants also realized that ¼" steel subplates can be stamped out of ¼" hot rolled steel bar stock with adequate precision. Cold rolled steel bar stock must be used when stamping out ½" weight plates since the bar stock must have greater dimensional consistency than when stamping from ¼" steel bar stock. For any given thickness of steel, hot rolled steel is much less expensive than cold rolled steel. Thus, an additional increment of savings is achieved because the ¼" steel subplates are desirably stamped out of hot rolled steel.

In addition, the Applicants also learned that one can control the stamping process to turn out ¼" steel subplates that are substantially free of edge imperfections or have such minor edge imperfections that a subsequent powder coating or painting process will substantially hide and cover such imperfections. A template (not shown) is provided to the stamping operator. This template is in the shape of the desired subplate that is to be stamped but is very slightly larger than that shape. This template is to be used in setting up the stamping operation.

More particularly, the stamping operator can run a few test shots in which a few ¼" steel subplates are stamped out. The stamping operator can then adjust the pressure used in the stamping operation and the cycle time to adjust for the hardness and other characteristics of the steel in the bar stock being used in the stamping operation until plates are stamped out that fit within the subplate template. In other words, adjustments are made by the stamping operator until the stamping tool is stamping out ¼" steel subplates that have such little edge imperfections that the subplates will fit within the subplate template. Then, an entire manufacturing run can be done to turn out hundreds or thousands of such subplates with substantially no waste. Substantially all of the subplates will fit within the template.

The result of this is that ¼" stamped steel subplates 14 can be used as weight subplates to form a larger ½" weight plate 10 without having to mill the edges to remove edge imperfections. Such weight subplates 14 can be used by the manufacturer of the exercise equipment directly as they come from the stamper as long as the stamper has taken care to ensure that the stamping operation is adjusted until the ¼" weight subplates fit within the subplate template. This provides another substantial savings to the manufacturer of the dumbbell. The dumbbell manufacturer no longer has to spend time or labor in milling weight plates 10 prior to their assembly in the selectorized dumbbell weight 6.

In manufacturing a selectorized dumbbell weight 6 according to this invention, a pair of the ¼" weight subplates 14 are sandwiched against one another to form a single ½" weight plate 10. However, before this is done, the Applicants further discovered that it is important to remove any residue of the lubricating oil that was used in the stamping process from both faces of ¼" weight subplates 14. If such lubricating oil is left on ¼" weight subplates 14, the oil on the faces that abut or contact with one another will then be trapped and cannot be removed in any subsequent cleaning step prior to powder coating. Then, when ¼" weight subplates 14 are eventually powder coated, the trapped oil will mar the coating process and cause the powder coating to undesirably bubble along the meeting line between the paired ¼" weight subplates 14.

Accordingly, ¼" weight subplates 14 desirably have any lubricating oil residue sufficiently removed therefrom such that the joined pair of ¼" weight subplates can subsequently be powder coated without bubbling or marring the powder coating. This oil residue removal can be accomplished in different ways. One way would be to clean or spray ¼" weight subplates 14 after they are stamped but before they are assembled together in pairs using a suitable cleaning solvent. Alternatively and preferably, the stamping operator can use an evaporating oil as the lubricant in the stamping process. Then, after ¼" weight subplates 14 are stamped out, the oil simply evaporates leaving a weight subplate 14 sufficiently clean of oil residue so that the subsequently applied powder coating will not bubble.

Figure 7:
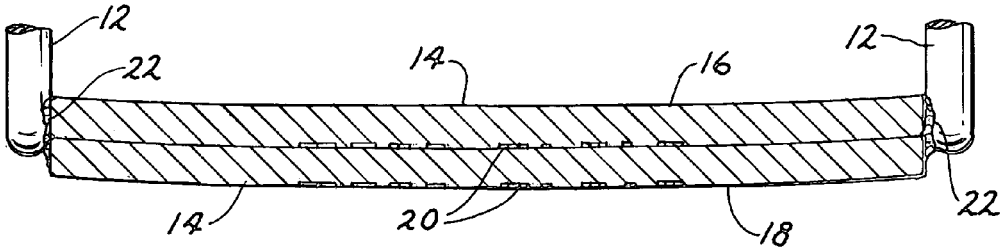
FIG. 7 is a cross-sectional view taken along lines 7-7 in FIG. 6 of the selectorized dumbbell weight of FIG. 2.
Figure 6:
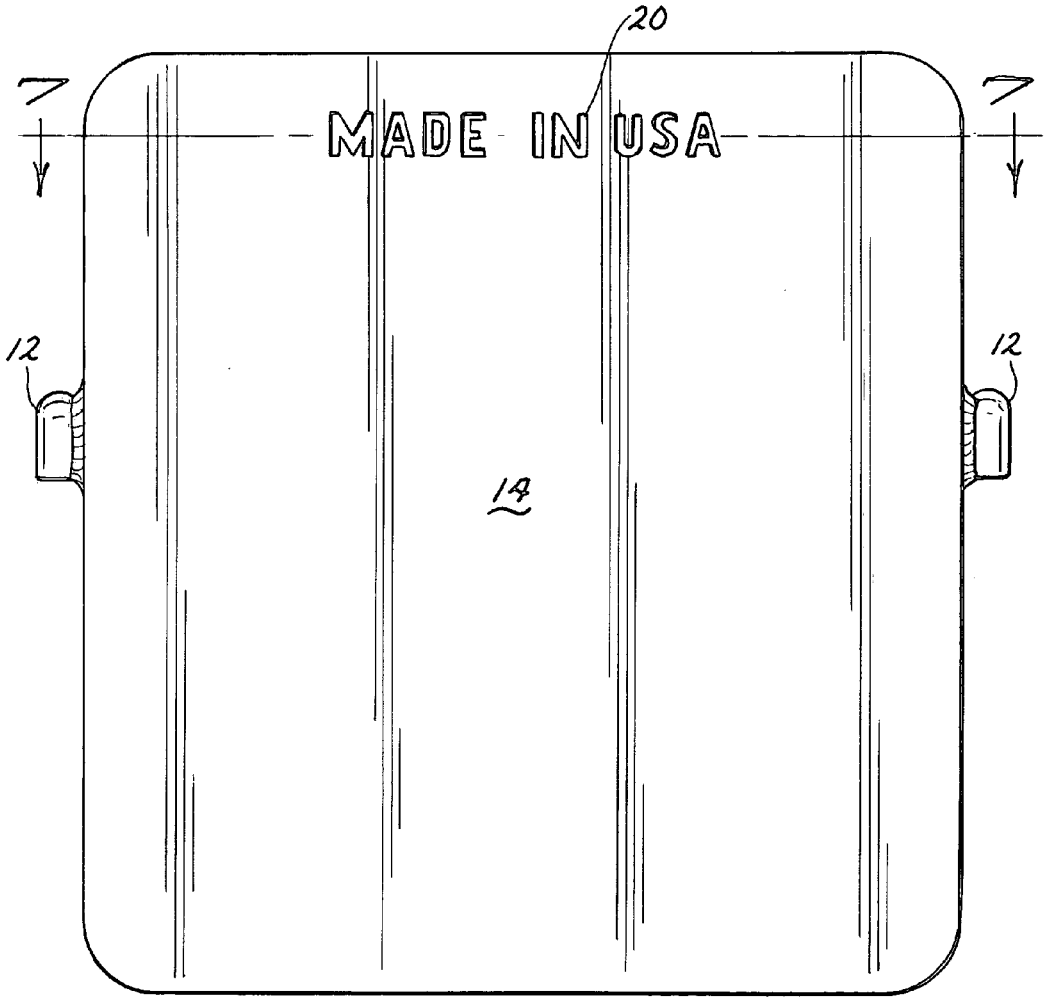
FIG. 6 is an end elevational view of the selectorized dumbbell weight of FIG. 2.

In any event, a pair of stamped ¼" weight subplates 14 which are sufficiently free of oil residue will be used to form each ½" left and right weight plate 10 of the selectorized dumbbell weight 6. The Applicants also realized that such stamped ¼" weight subplates 14 will be curved as a result of the stamping process and as a result of using hot rolled steel in the stamping process. One face 16 of weight subplate 14 is slightly concave and the other face 18 of weight subplate 14 is slightly convex. The amount of the curve in the concave and convex faces 16 and 18 is sufficiently small as to be imperceptible to the eye (the curve has been exaggerated in FIG. 7 for clarity). Thus, some type of indicia or mark 20, such as the words MADE IN USA, is stamped on the same face of each weight subplate 14, i.e. on convex face 18.

When the pair of stamped ¼" weight subplates 14 are placed into the welding fixture by an operator, the operator takes care so that the curvature indicia 20 on each subplate 14 is always in the same place facing towards the outside of the fixture. In other words, convex face 18 of each weight subplate 14 is to the outside of the fixture and concave face 16 is to the inside of the fixture. Thus, the two weight subplates 13 will smoothly mate with one another with convex outer face 18 of the innermost weight subplate 14 nested against the concave inner face 16 of the outermost weight subplate 14. See FIG. 7. This prevents tolerance problems from compounding themselves along the entire length of the nested weights 6.

After the stamped ¼" weight subplates are properly aligned and nested with each other and are in the welding fixture, side rails 12 can then be placed into the welding fixture. Each end of side rail 12 is positioned overlying the junction or interface between the pair of ¼" weight subplates 14 along one side of weight subplates 14. Again, see FIG. 7. The ends of side rails 12 can then be welded simultaneously to both of weight subplates 14 with the completed weld 22 bridging the interface between weight subplates 14 as well as joining weight subplates 14 to side rail 12. Such a weld 22 will adequately hold side rails 12 to weight subplates 14 as well as weight subplates 14 to each other.

After the welding step set forth above, weights 6 are finished in a conventional powder coating step. The welded weights 6, each comprising a ½" weight plate 10 formed by a pair of ¼" weight subplates 14 at each end of side rails 12, will then simply be powder coated to apply a finish coating over the entire surface of weights 6. This powder coating will substantially cover any edge imperfections that might have existed when ¼" weight subplates 14 were stamped.

The end result of this manufacturing method is a novel selectorized dumbbell weight 6 that is much less expensive to manufacture. Thus, a manufacturer can afford to keep selling selectorized dumbbells 2 having such weights 6 without substantially increasing the retail price of such dumbbells 2 even when the price of stamped steel plates is high. Alternatively, the profit margin made by the manufacturer can be maintained or increased.

In addition, much less material is lost when using two ¼" weight subplates rather than a single ½" weight plate. No milling is needed. Thus, none of the material of the ¼" weight subplate is lost by having to be stamped out to form mounting holes for the milling operation or by being milled away. Thus, for the same amount of steel used at the beginning of the manufacturing process, a complete selectorized dumbbell 2 manufactured according to this invention will be five pounds heavier (i.e. 90 pounds) than the corresponding selectorized dumbbell manufactured with ½" weight plates (i.e. 85 pounds). Thus, more value is delivered to the end user.

Various modifications of this invention will be apparent to those skilled in the art. Accordingly, the scope of this invention will be limited only by the appended claims.

We claim:

1. A selectorized dumbbell, which comprises:

(a) a handle;

(b) a plurality of weights that can be nested together forming a nested first stack of weight plates and a nested second stack of weight plates, the first and second stacks of weight plates being separated by a gap that is large enough to accommodate at least a portion of the handle therebetween, wherein each weight comprises a full thickness weight plate from the first stack and a full thickness weight plate from the second stack welded to opposed ends of at least one interconnecting member;

(c) a selector movable by a user to allow a desired number of weight plates from each of the first and second stacks to be coupled to either end of the handle when the handle portion is located in the gap between the first and second stacks and the selector is manipulated by the user; and (d) wherein the weight plates of each weight comprise full thickness weight plates, wherein each full thickness weight plate comprises a plurality of partial thickness stamped steel weight subplates that are abutted with one another and welded to one another to form the full thickness weight plate, and wherein the weld that joins each end of the interconnecting member to the full thickness weight plate is the same weld that joins together the partial thickness weight subplates that form the full thickness weight plate.

2. The selectorized dumbbell of claim 1, wherein a pair of interconnecting members are used to join the pair of full thickness weight plates together with one interconnecting member joining a front side of the weight plates together and the other interconnecting member joining the rear side of the weight plates together.

3. The selectorized dumbbell of claim 1, wherein the partial thickness weight subplates comprise a pair of half thickness weight subplates.

4. The selectorized dumbbell of claim 3, wherein each end of the interconnecting member is located over a junction where the pair of partial thickness weight subplates are abutted together.

5. The selectorized dumbbell of claim 1, wherein the partial thickness weight subplates each have a concave face and a convex face, and wherein the partial thickness weight subplates are abutted with one another with the convex face of each weight subplate being nested with the concave face of any adjacent weight subplate.

6. The selectorized dumbbell of claim 5, wherein indicia is provided on a corresponding face of the partial thickness weight subplates to help an operator properly nest the concave and convex faces of the abutted weight subplates.

7. The selectorized dumbbell of claim 1, wherein the partial thickness weight subplates are sufficiently free of any oil residue such that the partial thickness weight subplates after being welded together can be powder coated without having any powder coating bubble along a meeting line between the abutted weight subplates.

8. The selectorized dumbbell of claim 1, wherein the partial thickness weight subplates comprise a pair of half thickness weight subplates.

9. The selectorized dumbbell of claim 8, wherein the full thickness weight plate comprises a ½" weight plate and the partial thickness weight subplates comprise a pair of ¼" weight subplates.

10. The selectorized dumbbell of claim 1, wherein the partial thickness weight subplates are stamped from hot rolled steel bar stock.

* * * * *